United States Patent [19]

Wojcik

[11] Patent Number: 4,953,990

[45] Date of Patent: Sep. 4, 1990

[54] OVEREXTENSIBLE, THREE-PIECE TELESCOPIC GUIDE

[75] Inventor: Hendricus T. Wojcik, Eijsden, Netherlands

[73] Assignee: Thomas Regout N.V., Maastricht, Netherlands

[21] Appl. No.: 393,287

[22] Filed: Aug. 14, 1989

[30] Foreign Application Priority Data

Aug. 16, 1988 [NL] Netherlands ..... 8802030

[51] Int. Cl.[5] ..... A47B 88/00

[52] U.S. Cl. ..... 384/18; 312/286; 384/21

[58] Field of Search ..... 384/18–23; 312/286, 330 R, 341, 348

[56] References Cited

U.S. PATENT DOCUMENTS

| | | | |
|---|---|---|---|
| 1,363,687 | 12/1920 | Sorg | 312/286 |
| 1,736,108 | 11/1929 | Anderson et al. | 312/286 |
| 2,914,370 | 11/1959 | Hensch et al. | 312/286 |
| 4,178,049 | 12/1979 | Loo | 312/286 |
| 4,183,596 | 1/1980 | Greene et al. | 312/333 |

FOREIGN PATENT DOCUMENTS

| | | |
|---|---|---|
| 522087 | 7/1921 | France . |
| 345539 | 3/1931 | United Kingdom . |

*Primary Examiner*—Thomas R. Hannon

*Attorney, Agent, or Firm*—Weingarten, Schurgin, Gagnebin & Hayes

[57] ABSTRACT

An overextensible, three-piece telescopic guide comprising an outer or housing bar (1), a middle bar (2) and an inner or drawer bar (3). The bars are slidable relatively to each other by two ball cages (4,5) respectively mounted between the housing bar and the middle bar and between the middle bar and the drawer bar. For the purpose of locking the bars (1,2,3) in the direction of extension, loose sliding buffers (6,7) are mounted at both ends of the two ball cages (4,5) which sliding buffers are slidable within the corresponding bars and lock the middle and the drawer bars (2,3) in both extended end positions by end stops (12,14).

At each end (10) of the middle bar (2) a substantially triangular tilting member (8) is mounted, by which the guide's movement in the direction of extension is defined so that the drawer bar (2) and the middle bar (3) first move jointly outwardly until the middle bar (2) has reached its end position.

6 Claims, 2 Drawing Sheets

OVEREXTENSIBLE, THREE-PIECE TELESCOPIC GUIDE

The invention relates to an overextensible, three-piece telescopic guide comprising an outer or housing bar, a middle bar and one inner or drawer bar, which bars are slidable relatively to each other by means of two ball cages respectively mounted between the housing bar and the middle bar and between the middle bar and the drawer bar, there being provided end stops engaging with the ball cages for locking the bars in the extended position relatively to each other in the direction of extension.

A similar guide is known from Dutch patent application No. 83,04456. This known guide is extensible in one direction only. Extending the guide in the opposite direction is prevented by the shape of the end stops mounted in the bars. This is not a drawback in the case of guides mounted for supporting drawers of, for instance, desks of filing cabinets, which are extensible in one direction only. In the support of, for instance, boxes containing a plurality of parts at assembly lines or in storage racks, unilateral extensibility is an important drawback.

The present invention aims to provide a guide of the kind described, which is extensible in two directions and to this effect is characterized, according to the invention, in that at both ends of the two ball cages loose sliding buffers are mounted which are slidable within the corresponding bars and lock the middle bar and the drawer bar in both extended end positions by means of end stops.

Mounting loose sliding buffers that are slidable within the corresponding bars permits the end stops not to engage with the ball cages directly but with said loose sliding buffers, which in turn function as end stops for the ball cages. In this way it is possible for the bars to be locked in both directions of extension in the same way.

To lock the sliding buffers the middle bar is preferably provided with a strike plate at both ends which serves as an end stop for both the sliding buffer of the outer ball cage and the sliding buffer of the inner ball cage.

To prevent the inner or drawer bar from being taken out of the middle bar in the direction of extension, said inner bar is provided at both ends with inwardly turned side edges for locking the sliding buffers of the inner ball cage.

To ensure that when a drawer or box which is suspended from a three-piece guide is extended, the extension movement of the bars is defined such that first the drawer bar together with the middle bar travels in the direction of extension and that the drawer bar is not drawn from the middle bar until after said middle bar has reached its end position, a substantially triangular tilting member is mounted at each end of the middle bar, which member can pivot on a pin which is perpendicular to the bar movement direction, the drawer bar thus being locked in between the two tilting members when the guide is in the middle position and of which tilting member one corner can slide along the housing bar, in which position a second corner prevents the middle bar from being extended untimely relatively to the drawer bar.

The tilting member is preferably mounted on the pin under spring tension in such a way that the tilting member does not pivot until after the middle bar has reached its end position.

One embodiment of the three-piece guide according to the invention will be further described by way of example, with reference to the accompanying drawings, in which FIG. 1 shows a three-piece guide in the middle position;

Figure 3:
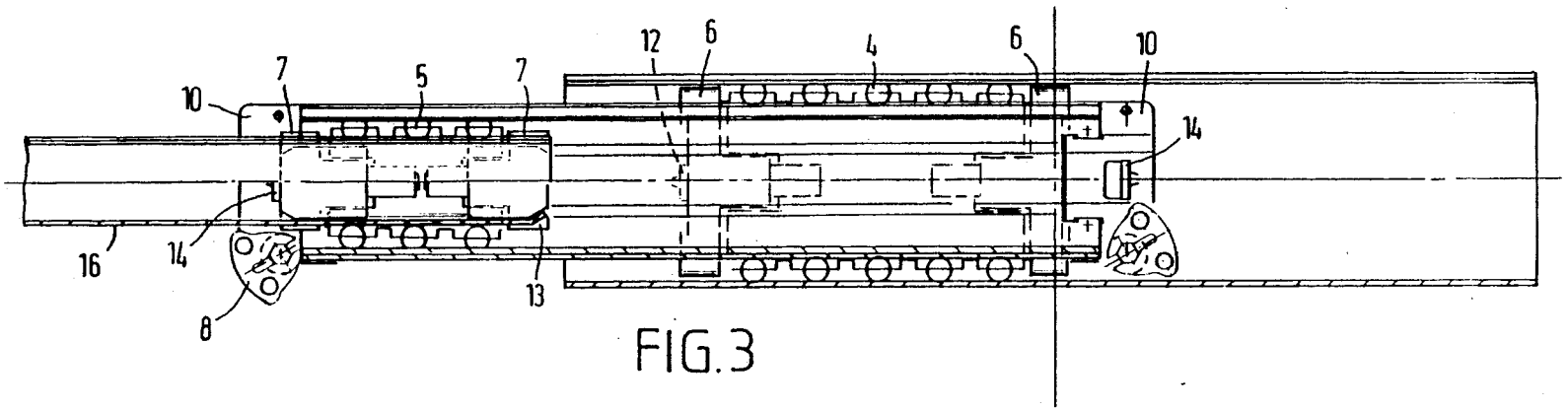
FIG. 3 shows a guide according to FIG. 1 in the fully extended position.

The three-piece guide comprises an outer or housing bar 1, a middle bar 2 and an inner or drawer bar 3, which are all approximately C-shaped in cross-section and slidable within one another with an outer ball cage 4 mounted between the housing bar 1 and the middle bar 2, and an inner ball cage 5 between the middle bar 2 and the drawer bar 3. At both ends of the ball cage 4, loose sliding buffers 6 are mounted which are slidable within the housing bar 1, while at both ends of ball cage 5, loose sliding buffers 7 are providing which are slidable within the middle bar. The sliding buffers 6 can be locked between an end face of the ball cage 4 and a strike plate 10, mounted at both ends of middle bar 2. The sliding buffers 7 are locked within the drawer bar 3 through the side edges of drawer bar 3 being turned inwardly at the end, as indicated in FIG. 3 at 13, with the sliding buffer at the other end engaging lip 14, as indicated in FIG. 3. At both ends of the housing bar 1 inwardly projecting lips 12 are fitted, which function as end stops for the sliding buffers 6. These lips 12 are of such height that the middle bar 2 with the strike plate 10 attached at the end may pass this lip 12 unhindered. The strike plates 10 of the middle bar 2 are fitted with inwardly projecting lips 14, whose height has been selected so that the drawer bar 3 may pass these lips 14 unhindered. The lips 14 serve as end stops for the sliding buffers 7 of the inner ball cage 5.

Figure 1:
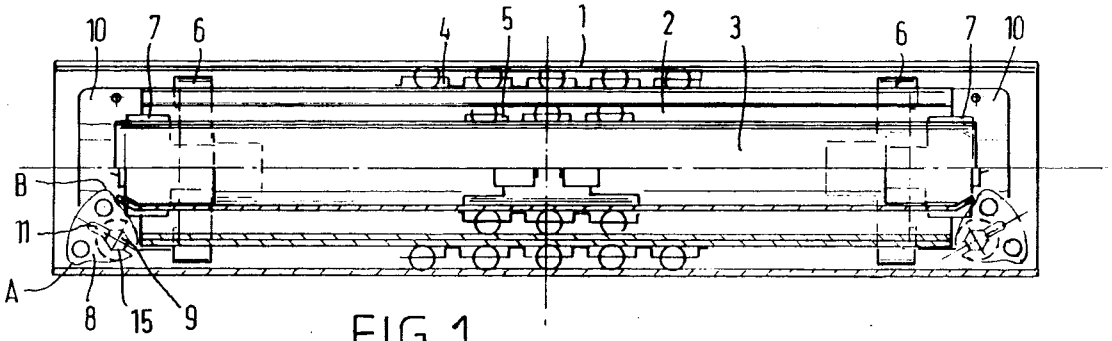

The strike plates 10 of the middle bar 2 are fitted with tilting members 8, provided with a hexagonal recess 15 and a slot 11 extending across said recess. On strike plate 10 a hexagonal pin 9 is mounted, whose axis is perpendicular to the direction of travel of the bars. The tilting member 8 is preferably made of synthetic plastics material and with its hexagonal recess 15 is forced on the hexagonal pin 9 to make a tight fit. In this way an adjustable resistance to the tilting member's pivoting is obtained, as will be explained further hereinafter. With the guide in the middle position as shown in FIG. 1 the corner A of the tilting member 8 engages the lower flange of the housing bar 1, while the corner B of the tilting member 8 projects into the travelling path of the drawer bar 3. As FIG. 1 shows, when the guide is in the middle position, the drawer bar 3 is locked between the two tilting members 8. The middle drawer bar 3, therefore, can only be moved outwardly in either direction together with the middle bar 2. Consequently it does not depend on accidental conditions of friction whether on pulling out a drawer only the drawer bar 3 slides within the middle bar 2 or only the middle bar 2 within the housing bar 1. With the help of the tilting members 8 at all events pulling out a drawer automatically brings out the combination of the drawer bar and the middle bar.

Figure 2:
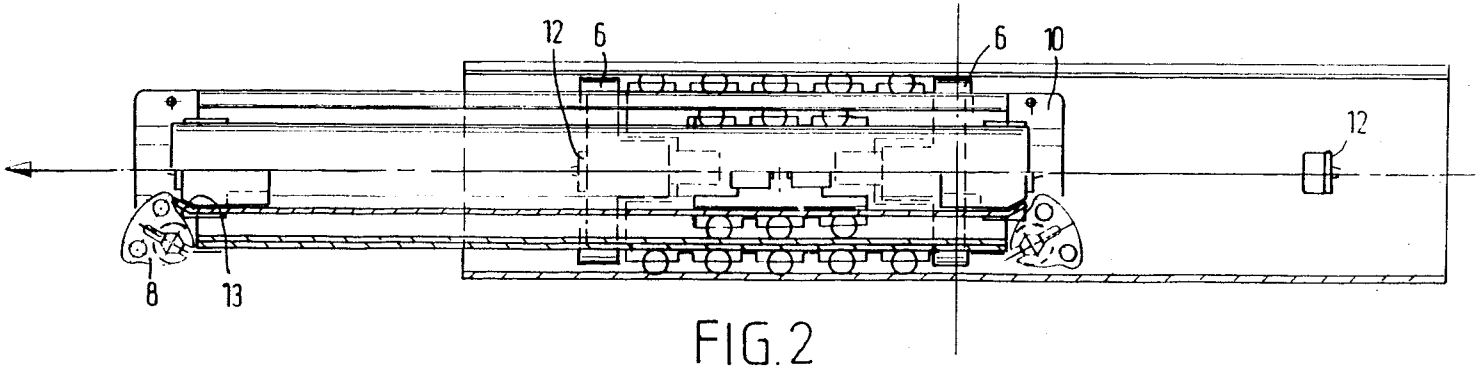
FIG. 2 shows a guide according to FIG. 1 in a partly extending position.

FIG. 2 shows the guide in a partly extended position, arrow X indicating the direction of travel. As shown by FIG. 2, the bars 2 and 3 have moved out together until the sliding buffer 6 engages lip 12 fitted in the housing bar 1 and functioning as an end stop for the sliding buffer 6. The outer ball cage 4 engages sliding buffer 6, which is locked in its end position, and the sliding buffer to the right of ball cage 4 engages the right-hand end of ball cage 4, whereby strike plate 10, which is connected to the middle bar 2, comes to lie in contact with sliding buffer 6. This prevents the middle bar 2 from travelling further in the X direction. When a drawer attached to the drawer bar 3 is pulled out further, the turned edge 13 of drawer bar 3 pushes against the corner B of the tilting member 8, which tilting member 8 then pivots on its hexagonal pin 9 thus permitting the drawer bar 3 to be pulled out further in the X direction until the end position shown in FIG. 3 is reached.

As shown by FIG. 3, the drawer bar 3 in the end position may lie entirely outside the housing bar 1, which is denoted by the term "overextensible". In the end position according to FIG. 3 the sliding buffer 7 is locked by lip 14 provided in the strike plate 10 of the middle bar 2 and functioning as an end stop. As shown by the drawing the drawer bar 3 can pass this end stop. The ball cage 5 comes to engage the locked sliding buffer 7, while the sliding buffer provided at the right-hand side of the drawer bar 3 is pressed against the right-hand end of the ball cage 5 by means of the turned edges 13. The guide is now in the extended position and locked in the direction of extension.

Figure 4:
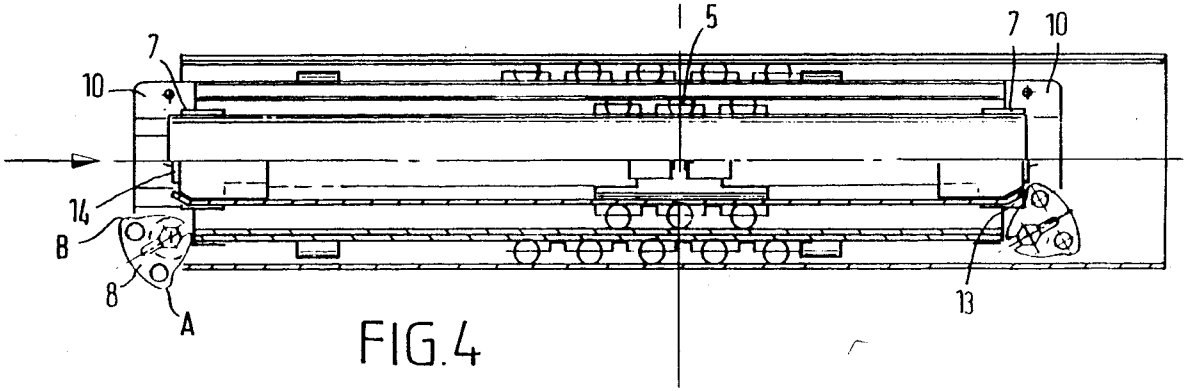
FIG. 4 shows the guide according to FIG. 1 in a position during retraction.

When the drawer bar 3 is pushed inwardly in the Y direction, shown in FIG. 4, the drawer bar 3 will as a rule slide into the middle bar 2 until the leading end of the drawer bar 3 engages the tilting member 8, which is shown on the right-hand side of FIG. 3. This tilting member 8 cannot pivot because its corner A abuts against the lower flange of the housing bar 1. When travelling further in the direction of Y the bars 2 and 3 will move together until the middle position shown in FIG. 1 is reached and the tilting member 8 shown at the left-hand end of the bar is made to pivot inwardly by the lower flange of the housing bar.

If, as the drawer bar 3 is moving inwardly in the Y direction, the drawer bar does not first slide into the middle bar 2, the drawer and middle bars will slide into the housing bar 1 together until the corner A of the tilting member 8 on the left engages the lower flange of the housing bar 1, and corner B engages the lower flange 16 of the drawer bar 3. On further movement in the Y direction only the drawer bar 3 will travel relatively to the middle bar, which is now locked, until corner B of the left-hand tilting member is clear of the lower flange 16 of the drawer bar. This tilting member 8 will then pivot and in the second instance permit the combination of middle bar 2 and drawer bar 3 to travel to the middle position accordinng to 1.

When the guide is extended in the other direction the respective parts operate in the same way relatively to each other as has been described hereinabove, namely mirror-image-wise relatively to the middle position shown in FIG. 1.

What I claim is:

1. An overextensible, three-piece telescopic guide comprising an outer or housing bar, a middle bar and one inner or drawer bar, which bars are slidable relatively to each other by means of two ball cages respectively mounted between the housing bar and the middle bar and between the middle bar and the drawer bar, there being provided end stops engaging with the ball cages for locking the bars in the extended position relatively to each other in the direction of extension, characterized in that at both ends of the two ball cages (4,5) loose sliding buffers (6,7) are mounted which are slidable within the corresponding bars and lock the middle and the drawer bars (2,3) in both extended end positions by means of end stops (12,14).

2. A telescopic guide according to claim 1, characterized in that the middle bar (2) is provided at both ends with a strike plate (10), which serves as an end stop for both the sliding buffer (6) of the outer ball cage (4) and the sliding buffer (7) of the inner ball cage (5).

3. A telescopic guide according to claim 1, characterized in that the drawer bar (3) is provided at both ends with inwardly turned side edges (13) for locking the sliding buffers (7) of the inner ball cage (5).

4. A telescopic guide according to claim 1, characterized in that at each end (10) of the middle bar (2) a substantially triangular tilting member device (8) is mounted, which can pivot on a pin (9) which is perpendicular to the direction of travel of the bars (X,Y), the drawer bar (3) thus being locked in between the two tilting members (8) when the guide is in the middle position, and of which tilting member (8) one corner (A) can slide along the outer bar (1), in which position a second corner (B) prevents the drawer bar (3) from sliding.

5. A telescopic guide according to claim 4, characterized in that the tilting member (8) is mounted on the pin under spring tension in such a way that the tilting member (8) does not pivot until after the middle bar (2) has reached its end position.

6. A telescopic guide according to claim 4, characterized in that the tilting member (8) is provided with a hexagonal recess (15) and a slot (11) extending across said recess, the pin (9) of the tilting member (8) being of hexagonal shape as well.

* * * * *